US005297306A

United States Patent [19]

Shandel

[11] Patent Number: 5,297,306

[45] Date of Patent: Mar. 29, 1994

[54] MULTIPURPOSE OUTDOOR TOOL

[76] Inventor: Frederick Shandel, 31200 Meadow Ridge Rd., Albion, Calif. 95410

[21] Appl. No.: 21,094

[22] Filed: Feb. 23, 1993

[51] Int. Cl.[5] ..... B25F 1/02

[52] U.S. Cl. ..... 7/114; 7/145; 7/148

[58] Field of Search ..... 7/145, 143, 144, 114, 7/167, 170, 148

[56] References Cited

U.S. PATENT DOCUMENTS

| | | | |
|---|---|---|---|
| 584,528 | 6/1897 | Stallings | 7/145 |
| 1,541,373 | 6/1925 | Micek | 7/145 |
| 1,574,660 | 2/1926 | Kimber | 7/145 |
| 2,501,757 | 3/1950 | Cagle | 7/145 |
| 3,245,094 | 4/1966 | Shandel | 7/1 |
| 3,561,023 | 2/1971 | Shandel | 7/14.55 |
| 3,824,641 | 7/1974 | Shandel | 7/14.55 |
| 3,837,023 | 9/1974 | Spencer-Foote | 7/145 |

FOREIGN PATENT DOCUMENTS

| | | | |
|---|---|---|---|
| 0032797 | 5/1912 | Sweden | 7/145 |
| 0027148 | 12/1905 | United Kingdom | 7/145 |

OTHER PUBLICATIONS

Sauber Mfg. Co., *Trailers*, "Putting Innovation Into Hardware", (undated), 16 pp.

*Primary Examiner*—Roscoe V. Parker

*Attorney, Agent, or Firm*—Harris Zimmerman

[57] ABSTRACT

An ax has an elongated socket extending along the top of the ax head in parallel relationship with the top of the ax blade. A detachable implement, which may be a spade blade, a pick point, a saw blade or any of various other implements, has a tang which is fitted into the socket to fasten the implement to the ax head. A spring biased latch pin, disposed in a passage in the ax head, has a first end that extends into an opening in the implement tang and an opposite end that protrudes from the the base of the ax head to enable retraction of the pin and replacement of the implement with a different implement. The socket is preferably open at both ends with the latch pin being midway between the ends enabling entry of an implement tang from either of two opposite directions to accommodate to reversible implements such as a combination hoe and rake blade.

10 Claims, 3 Drawing Sheets

FIG_4
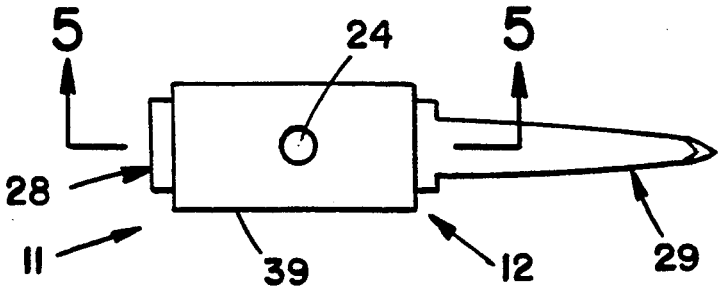
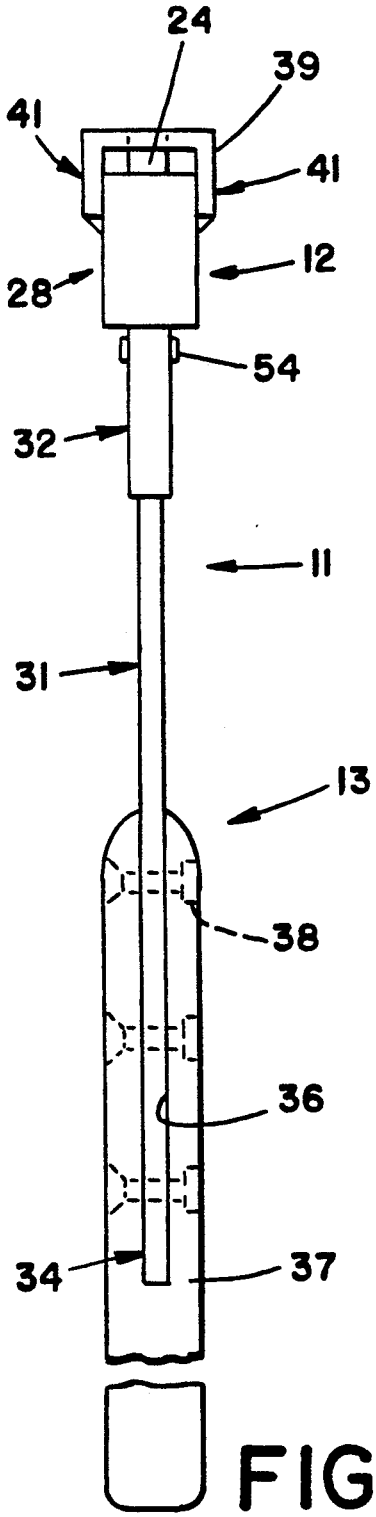
FIG_3
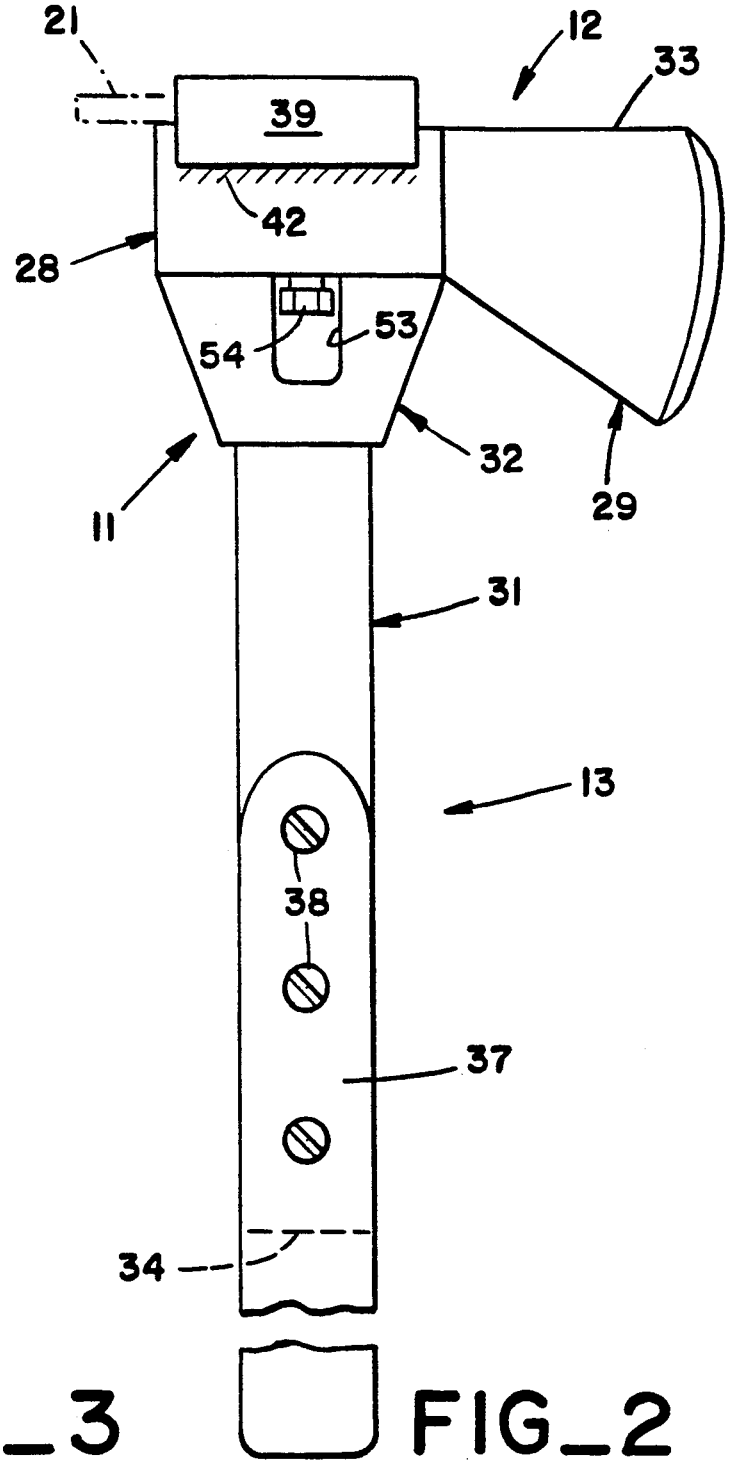
FIG_2

MULTIPURPOSE OUTDOOR TOOL

TECHNICAL FIELD

This invention relates to hand held tools and more particularly to axes for chopping wood or the like and which can be used to perform other operations by attaching any of a variety of interchangeable implements to the ax head.

BACKGROUND OF THE INVENTION

Campers, forestry personnel, householders and many other persons often need tools for performing any of a variety of operations such as chopping wood, hammering, digging, raking, hoeing, sawing and the like. It can be costly and cumbersome to obtain, store and transport a collection of tools each of which is useful only for a particular one of such operations.

My prior U.S. Pat. Nos. 3,245,094, issued Apr. 12, 1966; 3,561,023, issued Feb. 9, 1971 and 3,824,641, issued Jul. 23, 1974, disclose a type of outdoor tool that greatly alleviates the above discussed problem. The tool is basically an ax but enables attachment of any of a variety of auxiliary implements to the ax head. Such implements, which may for example include a spade blade, pick point, hoe blade or combination hoe and rake blade, can be detached from the tool and be replaced with a differing one of the implements as the need arises. Such a tool, together with a kit of the auxiliary implements, is much more compact and easier to store and transport than a collection of traditional tools for performing similar operations.

The auxiliary implements can be provided with tapered tangs which simply wedge into a conforming socket on the ax head as in U.S. Pat. No. 3,245,094 but a more positive attachment to the ax head as in U.S. Pat. Nos. 3,561,023 and 3,824,641 is preferable in order to prevent inadvertent separation of the implement from the ax head.

The positive implement fastening arrangements of the above identified patents require thumbscrews which engage in small clamping or wedging components that can be separated from the ax head and the auxiliary implement. It would be advantageous to provide for secure positive fastening of the implements to the ax head without the use of small separable components that can easily be mislaid or be overlooked when the tool elements are being gathered together or while one implement is being replaced with another.

The present invention is directed to overcoming one or more of the problems discussed above.

SUMMARY OF THE INVENTION

In one aspect of the invention, a multipurpose outdoor tool has a handle and an ax head at one end thereof and further includes means for optionally fastening an auxiliary tool implement to the ax head. The auxiliary implement has a tang and the ax head has a socket for receiving the tang. An interior passage in the ax head extends from the socket to an exterior surface of the ax head. A movable latch pin which extends within the passage has a first end which extends into the socket and into an opening in the implement tang that is seated in the socket. The latch pin is retractable from the socket to enable withdrawal of the tang.

In another aspect of the invention, the socket is elongated and open at both ends. The interior passage and movable latch pin are situated midway between the ends of the socket. This enables latching of implement tangs that may be entered into either end of the socket.

In still another aspect, the invention provides a multipurpose outdoor tool having a handle and an ax head thereon and having a replaceable auxiliary implement. The ax head has an outwardly extending blade and an elongated socket into which a tang on the implement is entered which socket extends along the top of the ax head in parallel relationship with the top of the blade. An interior passage in the ax head extends downward from the midpoint of the socket to the underside of the ax head. An axially movable latch pin extends through the passage and has a first end which extends into the socket and into an opening in the implement tang. The lower end of the latch pin protrudes below the underside of the ax head. A compression spring in the passage exerts a force on the latch pin that urges the pin in the direction of the socket.

The invention provides a compact, light weight tool that can be used for diverse different purposes, such as chopping, digging, hoeing, raking or sawing among other examples, by inter-changing different auxiliary implements that can be optionally attached to an ax head. Attachment and detachment of an auxiliary implement can be accomplished quickly and easily and without the use of small separable components that might be mislaid, be lost or be overlooked when the tool members are being gathered together. The invention is particularly advantageous for use in camping, as it is usually impossible or at least inconvenient to transport and store a bulky collection of traditional specialized tools at such times, and is also highly useful under many other circumstances.

The invention, together with further aspects and advantages thereof may be further understood by reference to the following description of a preferred embodiment and by reference to the accompanying drawings.

BRIEF DESCRIPTION OF THE DRAWINGS

FIG. 2 is a foreshortened side view of the tool of FIG. 1.

FIG. 3 is a foreshortened rear view of the tool of the preceding figures.

FIG. 4 is a top view of the tool of the preceding figures.

DETAILED DESCRIPTION OF THE PREFERRED EMBODIMENT

Figure 1:
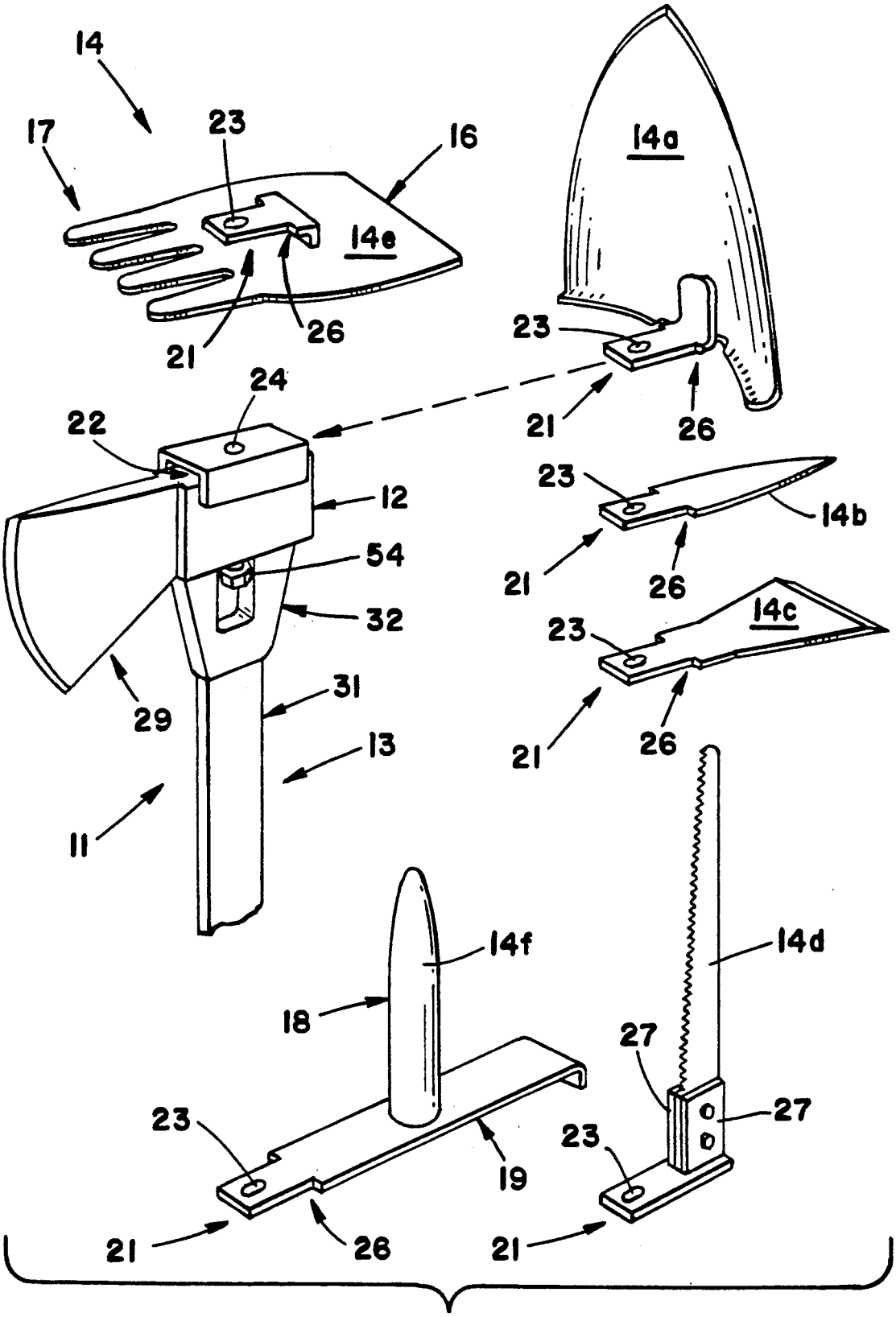
FIG 1 is a perspective view of a multipurpose tool including representative examples of replaceable auxiliary implements that can optionally be attached to the tool.

Referring initially to FIG. 1 of the drawings, a multipurpose outdoor tool 11 in accordance with this embodiment of the invention includes an ax head 12 secured to the upper end of a handle 13 and one or more detachable auxiliary implements 14 which may optionally be fastened to the ax head. The implements depicted in FIG. 1 for purposes of example include a spade blade 14*a*, a pick point 14*b*, a grub hoe blade 14*c*, a saw blade 14*d*, a combination hoe and rake blade 14*e* having a linear sharp edge 16 for hoeing and having spaced apart rake tines 17 along the opposite edge. Implement 14*f* is a tree planting attachment having a tapered spike 18 extending at right angles from a bar portion 19 of the implement. Spike 18 may be forced into the ground, by applying foot pressure to bar portion 19, to form holes into which seeds may be dropped. Additional implements 14, designed for diverse other operations may also be provided if desired.

Each implement 14*a* to 14*f* has a tang 21 proportioned to enter an elongated socket 22 which extends along the top of ax head 12. The tangs 21 of spade 14*a* and saw blade 14*d* are angled relative to the other portions of the implement as such implements preferably extend in the same or nearly the same direction as the tool handle 13 during use. The tangs 21 of pick point 14*b* and grub hoe 14*c* are coplanar with other portions of the implements as such implements should extend more or less at right angles with handle 13 during use. Tang 21 of tree planting implement 14*f* is aligned with the bar portion 19 of the implement so that the spike 18 will extend downward when the tool 11 is inverted. The tang 21 of the combination hoe and rake 14*e* is at a central location on one face of the implement and is spaced apart and parallel to the blade region 24. This enables seating of the tang 21 in socket 22 with either the hoe edge 16 or the rake tines 17 in an outwardly extending relationship with the the ax head 12.

The tang 21 of each of the auxiliary implements 14*a* to 14*f* is transpierced by a circular opening 23 into which a retractable latch pin 24 extends when the tang is seated in socket 22 and the selected implement 14 is thereby locked to the ax head 12 in a positive manner. To facilitate the process of fastening a selected implement 14 to ax head 12, the tangs 21 may be formed with a shoulder 26 along each edge of the tang which shoulders limit insertion of the tang into socket 22 at the point where the opening 23 is in register with latch pin 24. Saw blade implement 14*d* lacks such shoulders as a similar stop function is performed by a pair of spaced apart parallel saw blade clamping plates 27 which extend at right angles to the tang.

Socket 22 is open at both ends and latch pin 24 is situated midway between the ends of the socket, the length of the socket being such that opening 23 of a tang 21 registers with the pin when the tang shoulders 26 abut either end of the socket. This enables insertion of tangs 21 into either end of the socket 22 such as is necessary to make use of both the hoeing and raking functions of implement 14*e*.

Referring jointly to FIGS. 2, 3 and 4, the terms front, rear, forward, top, underside and the like as used herein and in the appended claims should be understood to refer to the tool 11 when it is in the upright position that is depicted in the drawings at which handle 13 is vertical and ax head 12 is the uppermost component.

Ax head 12 in this example of the invention has a rectangular body 28, an ax blade 29 which extends outward at the front end of body 28, an elongated flat linear bar 31 which forms the upper portion of the ax handle 13 and a tapered connector region 32 which is thicker than bar 31 and which joins the upper end of the bar to the underside of body 28. The above described portions of the ax head 12, including body 28, blade 29, bar 31 and connector region 32 are preferably a single integral body of metal. A flat, linear surface 33 extends along the top of the ax head including both body 28 and blade 29.

The lower end 34 of bar 31 is fitted into a conforming longitudinal slot 36 in the upper portion of a linear wooden handle member 37 and the two members are secured together by transverse bolts 38.

Socket 22 is formed by a channel member 39 which extends along the top of the ax head body 28 in parallel relationship with the flat top surface 33. The upper portion of ax head body 28 extends up between the side regions 41 of channel member 39 which member is secured to body 28 by welds 42. The ax head body 28 and channel member 39 are centered relative to ax handle 13 and are proportioned to impart a cross-sectional shape to socket 22 that conforms with the cross section of the previously described auxiliary implement tangs 21.

Figure 5:
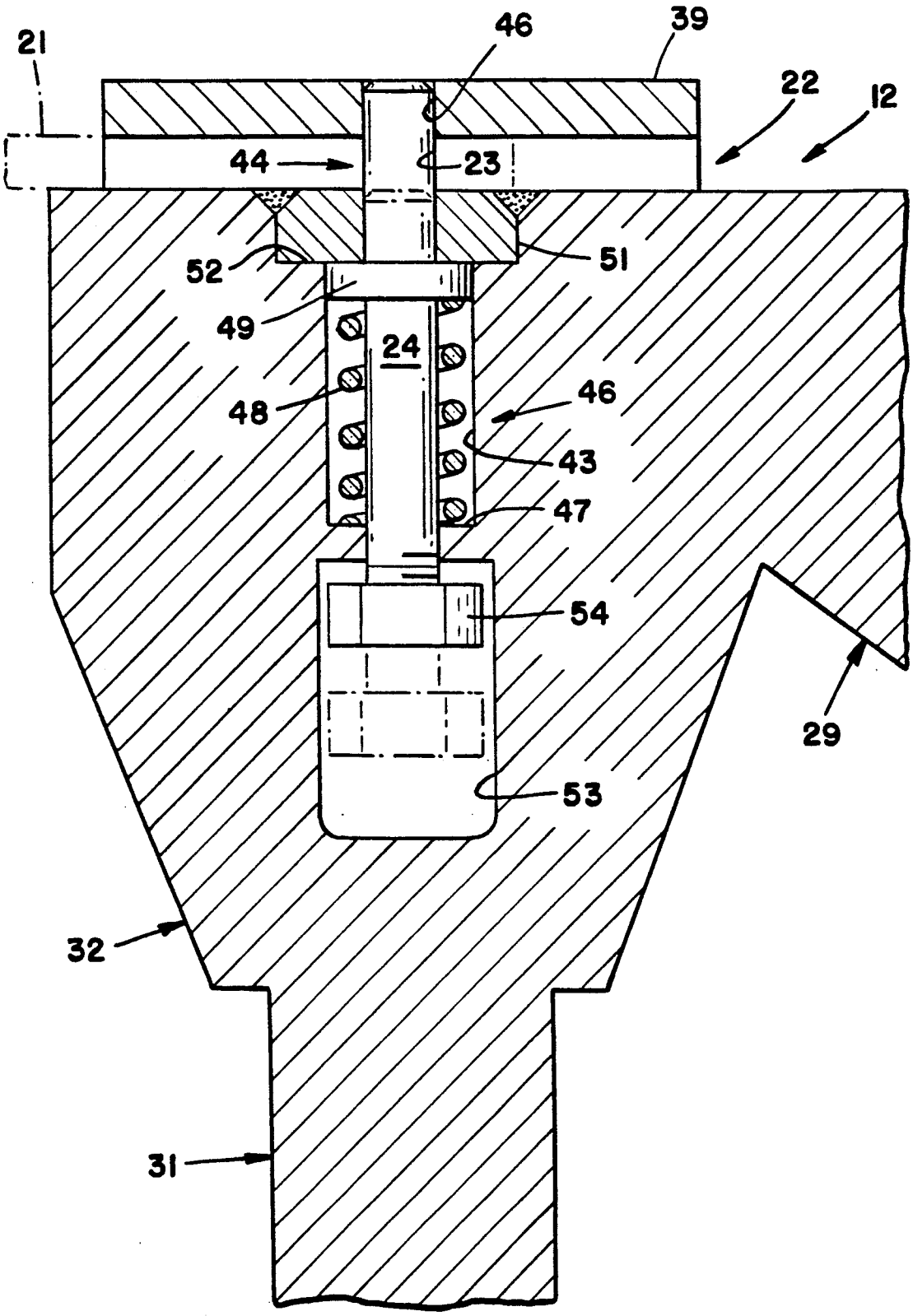
FIG. 5 is a section view of a portion of the tool taken along line 4—4 of FIG. 4.

Referring to FIG. 5, a stepped interior passage 43 within ax head body 28 is aligned with the centerline of handle 13 and intersects socket 22 at a location which is midway between the ends of the socket. Latch pin 24 extends along the axis of passage 43 and has an upper end 44 which may extend across socket 22, through the previously described opening 23 of an auxiliary implement tang 21, and into an opening 46 in channel member 39 to latch an implement to the ax head 12.

Spring means 46 exert a force on pin 24 which urges the pin towards socket 22 and thus towards the tang latching position of the pin. More specifically, the lower end of passage 43 has a diameter conforming to the diameter of pin 24 and is of larger diameter above a first annular step 47 in the passage. A helical compression spring 48 is disposed in passage 43 in coaxial relationship with pin 24 and has a lower end which seats against step 47. The upper end of spring 48 bears against a flange 49 of pin 24 and thus the pin is urged upward in the direction of socket 22. Upward motion of the pin 24 is limited, at the point where the upper end 44 of the pin extends across socket 22 and into channel member opening 46, by an annular stop 51 which is secured within the upper end of passage 43 and which abuts another step 52 of the passage.

To enable removal and/or insertion of an implement tang 21 at socket 22, the connector region 32 of ax head 12 has a window opening 53 situated below the lower end of passage 43 and pin 24 extends downward into the opening. An enlargement 54 is secured to the lower end of the pin. Thus the pin 24 may be temporarily retracted from socket 22, to release or receive an implement tang 21, by drawing enlargement 54 down against the force of spring 48. Upon release of the enlargement 54, spring 48 snaps the pin 24 back to the tang latching position and holds the pin at that position until such time as it is again deliberately retracted. Attachment and detachment of the auxiliary implements in this manner can be effected easily and quickly and the mechanism provides a strong and secure positive fastening of the implements to the ax head 12.

While the invention has been disclosed with reference to a particular preferred embodiment for purposes of example, many modifications and variations of the tool configuration are possible and it is not intended to limit the invention except as defined in the following claims.

I claim:

1. A multipurpose outdoor tool having a handle and an ax head at one end thereof, said tool further having means for optionally fastening an auxiliary tool implement to said ax head, said auxilary implement having a tang for engaging said ax head which tang has an opening therein and said ax head having a socket for receiving said tang, wherein the improvement comprises:

said ax head having an interior passage which extends from said socket to an exterior surface of said ax head, further including a movable latch pin extending within said passage, said latch pin being slidable along said passage between first and second positions at each of which at least a portion of said latch pin remains within said passage, and wherein said latch pin has a first end which extends into said socket when said latch pin is at said first position and which enters said tang opening when a tang is seated in the socket and said latch pin is at said first position, said latch pin being retractable from said socket by sliding of said latch pin towards said second position to enable withdrawal of said tang, further including means for limiting axial movement of said latch pin to movement between said first and second positions thereof which means prevents inadvertent separation of said latch pin and said ax head.

2. A multipurpose outdoor tool having a handle and an ax head at one end thereof, said tool further having means for optionally fastening an auxiliary tool implement to said ax head, said auxilary implement having a tang for engaging said ax head which tang has an opening therein and said ax head having a socket for receiving said tang, wherein the improvement comprises:

said ax head having an interior passage extends from said socket to an exterior surface of said ax head, further including a movable latch pin extending within said passage and having a first end which extends into said socket and enters said tang opening when a tang is seated in the socket, said latch pin being retractable from said socket to enable withdrawal of said tang, wherein said socket is elongated and open at both ends, said interior passage and latch pin being situated midway between said ends whereby said tang may be entered into either end of said socket and be engaged by said latch pin.

3. A multipurpose outdoor tool having a handle and ax head at one end thereof, said tool further having means for optionally fastening an auxiliary tool implement to said ax head, said auxilary implement having a tang for engaging said ax head which tang has an opening therein and said ax head having a socket for receiving said tang, wherein the improvement comprises:

said ax head having an interior passage which extends from said socket to an exterior surface of said ax head, further including a movable latch pin extending within said passage and having a first end which extends into said socket and enters said tang opening when a tang is seated in the socket, said latch pin being retractable from said socket to enable withdrawal of said tang, wherein said socket is elongated and extends along the top of said ax head and wherein said interior passage and latch pin extend downward within said ax head, said latch pin having a second end which protrudes from said passage at said exterior surface of said ax head, and wherein said socket has an inner wall with a pin receiving opening therein that conforms with said first end of said latch pin and which is situated opposite from said interior passage, and wherein said movable latch pin is proportioned to extend across said socket and into said pin receiving opening when said tang is seated in said socket.

4. A multipurpose outdoor tool having a handle and an ax head at one end thereof, said tool further having means for optionally fastening an auxiliary tool implement to said ax head, said auxilary implement having a tang for engaging said ax head which tang has an opening therein and said ax head having a socket for receiving said tang, wherein the improvement comprises:

said ax head having an interior passage which extends from said socket to an exterior surface of said ax head, further including a movable latch pin extending within said passage and having a first end which extends into said socket and enters said tang opening when a tang is seated in the socket, said latch pin being retractable from said socket to enable withdrawal of said tang, wherein said socket is elongated and extends along the top of said ax head and wherein said interior passage and latch pin extend downward within said ax head, said latch pin having a second end which protrudes from said passage at aid exterior surface of said ax head, and wherein said interior passage and said latch pin are substantially co-linear with said handle and wherein said tool has a window opening situated below said passage, and wherein said second end of said latch pin extends into said window opening.

5. A multipurpose outdoor tool having a handle and an ax head at one end thereof, said tool further having means for optionally fastening an auxiliary tool implement to said ax head, said auxilary implement having a tang for engaging said ax head which tang has an opening therein and said ax head having a socket for receiving said tang, wherein the improvement comprises:

said ax head having an interior passage which extends from said socket to an exterior surface of said ax head, further including a movable latch pin extending within said passage and having a first end which extends into said socket and enters said tang opening when a tang is seated in the socket, said latch pin being retractable from said socket to enable withdrawal of said tang, further including spring means for exerting a force on said latch pin that resists retraction of said pin from said socket.

6. The tool of claim 5 wherein said spring means includes a helical compression spring disposed in said interior passage of said ax head in coaxial relationship with said latch pin.

7. A multipurpose outdoor tool having a handle and an ax head at one end thereof, said tool further having means for optionally fastening an auxiliary tool implement to said ax head, said auxilary implement having a tang for engaging said ax head which tang has an opening therein and said ax head having a socket for receiving said tang, wherein the improvement comprises:

said ax head having an interior passage which extends from said socket to an exterior surface of said ax head, further including a movable latch pin extending within said passage and having a first end which extends into said socket and enters said tang opening when a tang is seated in the socket, said latch pin being retractable from said socket to enable withdrawal of said tang, and wherein said socket is elongated and extends along the top of said ax head in parallel relationship with the top of said ax blade and wherein said interior passage and said latch pin extend downward within said ax head and said pin has a second end with an enlargement that protrudes from said passage at said exterior surface of said ax head, further including a spring disposed in said interior passage of said ax head and having an end which exerts an upward force on said latch pin.

8. The tool of claim 7 wherein said socket is open at both ends and said passage and latch pin are situated midway between said ends and directly above said handle.

9. A multipurpose outdoor tool having a replaceable auxiliary implement which has a tang with an opening therein for fastening the implement to the tool, said tool being comprised of:

an elongated handle having a head end, an ax head secured to said head end of said handle and having an outwardly extending ax blade and an elongated socket into which said implement tang is entered and which extends along the top of said ax head in parallel relationship with the top of said ax blade and further having an interior passage which extends downward from the midpoint of said socket to an exterior surface of said ax head, an axially movable latch pin extending through said passage and having a first end which extends therefrom into said socket and into said opening of said tang, said latch pin having an opposite end that protrudes from said ax head below said passage, and a compression spring disposed in said passage in said ax head in position to exert a force on said latch pin which urges said pin in the direction of said socket.

10. The tool of claim 9 wherein said socket is open at both ends and said interior passage and latch pin are situated midway along the length of said socket and are located directly above said handle, said tool having a window opening therein situated below said passage and into which said opposite end of said latch pin protrudes.

* * * * *